US010297111B2

(12) United States Patent
Czubak

(10) Patent No.: US 10,297,111 B2
(45) **Date of Patent: *May 21, 2019**

(54) SYSTEMS, METHODS, AND GAMING MACHINES HAVING ADJUSTABLE PROGRESSIVE AWARDS

(71) Applicant: Novomatic AG, Gumpoldskirchen (AT)

(72) Inventor: Roman Czubak, Traiskirchen (AT)

(73) Assignee: Novomatic AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,291

(22) Filed: Aug. 25, 2017

(65) Prior Publication Data

US 2018/0061183 A1 Mar. 1, 2018

Related U.S. Application Data

(63) Continuation of application No. 15/362,469, filed on Nov. 28, 2016, now Pat. No. 9,779,584.

(60) Provisional application No. 62/379,642, filed on Aug. 25, 2016.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3258* (2013.01); *G07F 17/3225* (2013.01); *G07F 17/3234* (2013.01); *G07F 17/34* (2013.01)

(58) Field of Classification Search

None

See application file for complete search history.

(56) References Cited

U.S. PATENT DOCUMENTS

| | | | | |
|---|---|---|---|---|
| 9,336,646 | B2 | 5/2016 | Pirvu | |
| 9,779,584 | B1 | 10/2017 | Czubak | |
| 2006/0025210 | A1* | 2/2006 | Johnson | G07F 17/32 463/25 |

(Continued)

FOREIGN PATENT DOCUMENTS

| | | |
|---|---|---|
| WO | 2006015335 | 2/2006 |

OTHER PUBLICATIONS

USPTO; Non-Final Office Action dated Feb. 21, 2017 in U.S. Appl. No. 15/362,469.

(Continued)

*Primary Examiner* — Lawrence S Galka
(74) *Attorney, Agent, or Firm* — Snell & Wilmer L.L.P.

(57) ABSTRACT

A gaming system may include a gaming machine having a monetary input device, a wager input device, and a processor may be coupled to the wager input device and a memory device. The processor may establish a credit balance based on the monetary value, decrease the credit balance by the selected wager, and present the wagering game at an interface. The wagering game may include a jackpot winnable based on an outcome of the wagering game. A game server may transmit content for the wagering game to the gaming machine. The game server may also determine a plurality of parameters relating to the jackpot, track a turnover of the gaming machine, and change a parameter of the plurality of parameters in response to comparison of the turnover to a predetermined value.

20 Claims, 6 Drawing Sheets

(56) References Cited

U.S. PATENT DOCUMENTS

| | | | | |
|---|---|---|---|---|
| 2008/0108423 | A1* | 5/2008 | Benbrahim | G07F 17/34 463/25 |
| 2009/0275399 | A1* | 11/2009 | Kelly | G07F 17/323 463/27 |
| 2009/0305776 | A1* | 12/2009 | Englman | 463/25 |
| 2010/0048293 | A1* | 2/2010 | Hornik | G07F 17/3244 463/25 |
| 2010/0304832 | A1* | 12/2010 | Kup-Ferroth | G07F 17/32 463/20 |
| 2011/0021268 | A1* | 1/2011 | Bramble | G07F 17/3258 463/26 |
| 2013/0225277 | A1* | 8/2013 | Hughes | G07F 17/3258 463/27 |
| 2014/0162762 | A1 | 6/2014 | Aoki et al. | |
| 2016/0027257 | A1 | 1/2016 | Yoseloff et al. | |
| 2016/0042609 | A1* | 2/2016 | Kitamura | G07F 17/3258 463/20 |
| 2017/0053486 | A1 | 2/2017 | Talkeda | |
| 2017/0169657 | A1 | 6/2017 | Keilwert | |

OTHER PUBLICATIONS

USPTO; Final Office Action dated Jun. 26, 2017 in U.S. Appl. No. 15/362,469.

USPTO; Notice of Allowance dated Aug. 14, 2017 in U.S. Appl. No. 15/362,469.

EPO; European Search Report dated Dec. 12, 2017 in Application No. 17198384.4.

* cited by examiner

SYSTEMS, METHODS, AND GAMING MACHINES HAVING ADJUSTABLE PROGRESSIVE AWARDS

CROSS-REFERENCE TO RELATED APPLICATIONS

This U.S. Continuation application claims priority to U.S. Non-Provisional application Ser. No. 15/362,469, which was filed on Nov. 28, 2016 and entitled "SYSTEMS, METHODS, AND GAMING MACHINES HAVING ADJUSTABLE PROGRESSIVE REWARDS," which is a U.S. Non-Provisional application claiming priority to U.S. Provisional Patent Application No. 62/379,642, which was filed on Aug. 25, 2016 and entitled "SYSTEMS, METHODS, AND GAMING MACHINES HAVING ADJUSTABLE PROGRESSIVE REWARDS" all of which is incorporated by reference herein in its entirety.

FIELD

The present disclosure relates generally to gaming machines and, more particularly, to gaming machines found in casinos or betting environments.

BACKGROUND

Gaming machines, otherwise known as slot machines, poker machines, video lottery terminals, or gaming consoles, have proven very popular within the gaming environment to become one of the base elements of the gaming industry. Players, however, quickly become tired of various adaptations of gaming machines, demanding new and inventive ways to represent or play games on such gaming machines. For this reason, game creators must continually invent new and innovative ways to represent games, game play, and award types to stimulate players to encourage further interest.

One type of award that may be presented on gaming machines to increase interest among players is a mystery jackpot or award. These mystery jackpots may be progressive jackpots that start at a minimum award amount. The jackpot increases based on an amount of gameplay on the machine up to a maximum amount. In some embodiments, if the jackpot amount that is able to be won increases above a win threshold, the player who causes the jackpot to cross the win threshold may be awarded the mystery jackpot.

A typical casino or other gaming establishment will have a fluctuating number of players play on the gaming machines. In addition, players will play different amounts at different times. Accordingly, for systems that implement a mystery jackpot or similar prize mechanism, it may be difficult to accurately determine a typical or expected payout amount for the gaming machines throughout the gaming establishment. In addition, if game play increases or decreases on the gaming machines throughout a particular time period, a casino may end up paying jackpots more often as compared to a frequency of jackpot payouts originally forecasted, resulting in spending more in the same time period.

SUMMARY

A gaming system including a gaming machine is provided. The gaming machine includes a monetary input device configured to receive a physical item associated with a monetary value. A wager input device may be configured to receive an input representative of a selected wager for a wagering game. The selected wager may be selected from a list of approved wagers. A processor may be coupled to the wager input device and a memory device, and the processor may establish a credit balance based on the monetary value, decrease the credit balance by the selected wager, and present the wagering game at an interface. The wagering game may include a jackpot winnable based on an outcome of the wagering game. A game server may transmit content for the wagering game to the gaming machine. The game server may also determine a plurality of parameters relating to the jackpot, track a turnover of the gaming machine, and change a parameter of the plurality of parameters in response to comparison of the turnover to a predetermined value.

In various embodiments, the award server may transmit the parameter to the gaming machine in response to the change of the parameter. The award server may also restore the parameter to a previous value in response to the parameter being greater than a parameter value threshold. The award server may transmit the parameter to the gaming machine in response to receiving an approval of the parameter. The award server may change the parameter by increasing the parameter in response to a determination that the turnover is greater than the predetermined value. The award server may also change the parameter by decreasing the parameter in response to a determination that the turnover is less than the predetermined value.

BRIEF DESCRIPTION OF THE DRAWINGS

Non-limiting and non-exhaustive embodiments of the present disclosure are described with reference to the following figures, wherein like reference numerals refer to like parts throughout the various views unless otherwise specified.

DETAILED DESCRIPTION

Figure 1:
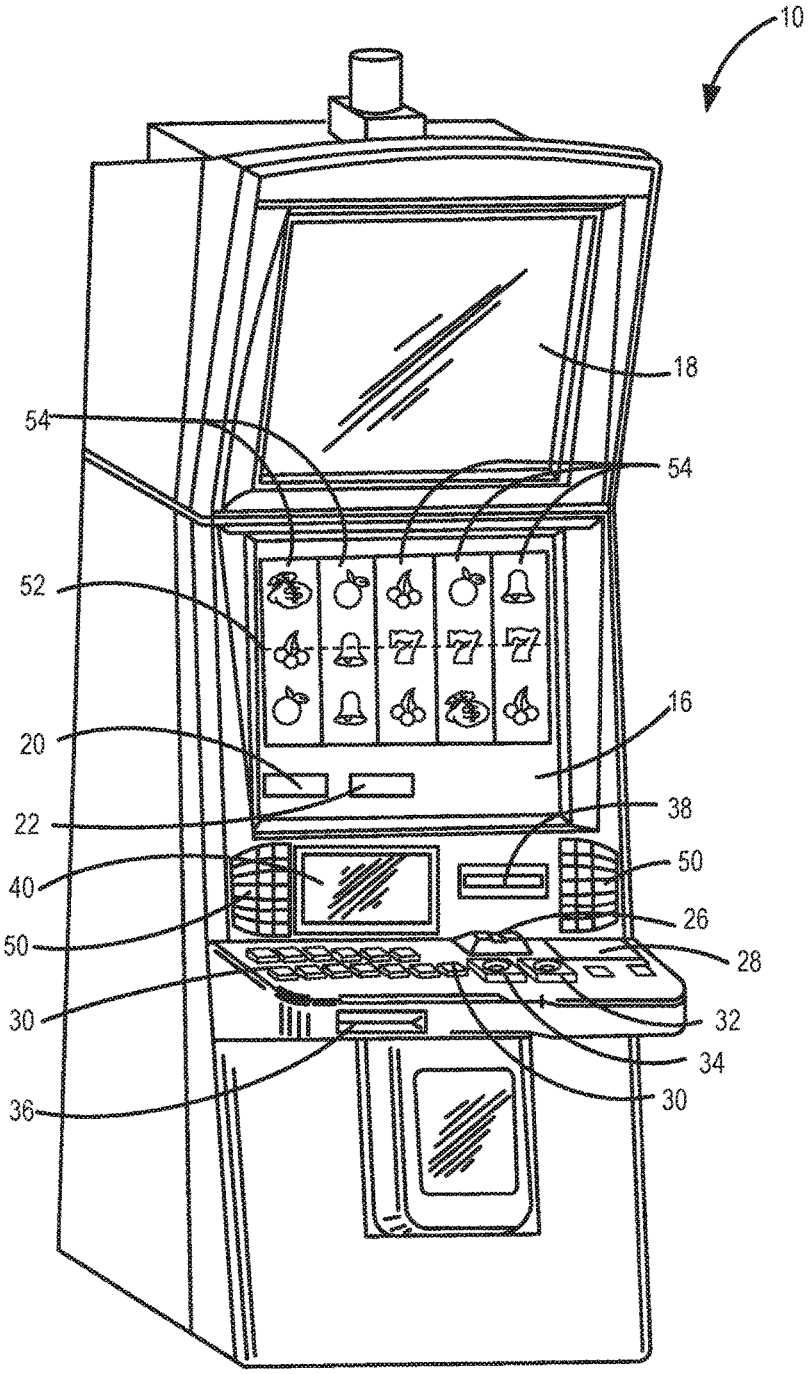
FIG. 1 is a perspective view of a gaming machine which allows for playing of a casino game with multiple reels, according to various embodiments.

Reference throughout this specification to "one embodiment", "an embodiment", "one example" or "an example" means that a particular feature, structure or characteristic described in connection with the embodiment or example is included in at least one embodiment of the present disclosure and may be variously included on many embodiments. Thus, appearances of the phrases "in one embodiment", "in an embodiment," "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Several (or different) elements discussed below, and/or claimed, are described as being "coupled," "in communication with," or "configured to be in communication with." This terminology is intended to be non-limiting, and where appropriate, be interpreted to include without limitation, wired and wireless communication using any one or a plurality of a suitable protocols, as well as communication methods that are constantly maintained, are made on a periodic basis, and/or made or initiated on an as needed basis.

The methodologies described herein may be implemented by various means depending upon applications according to particular examples. For example, such methodologies may be implemented in hardware, firmware, software, or combinations thereof. In a hardware implementation, for example, the controller or processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the description included herein are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the signal processing or related arts to convey the substance of their work to others skilled in the art. An algorithm is here, and generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be appreciated, however, that all of these or similar terms are to be associated with appropriate physical quantities and are merely convenient labels.

Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this description, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

For clarity in discussing the various functions of the system, multiple computers and/or servers are discussed as performing different functions. These different computers (or servers) may, however, be implemented in multiple different ways such as modules within a single computer, as nodes of a computer system, etc. The functions performed by the system (or nodes or modules) may be centralized or distributed in any suitable manner across the system and its components, regardless of the location of specific hardware. Furthermore, specific components of the system may be referenced using functional terminology in their names. The function terminology is used solely for purposes of naming convention and to distinguish one element from another in the following discussion. Unless otherwise specified, the name of an element conveys no specific functionality to the element or component. It should be appreciated that, in selected embodiments, the software, hardware, and associated components of the system may be programmed and configured to implement one or more embodiments described herein. It should also be appreciated that the various aspects of the system may be exemplified as software, modules, nodes, etc., of a computer or server.

Embodiments of the present invention may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and/or memory devices. In such a "thick client" embodiment, the gaming device local processor executes the communicated computerized instructions to control any games (or other suitable interfaces) provided to a player.

Referring to FIG. 1, one embodiment of a gaming machine or device 10, according to the present disclosure, has a support structure, housing, or cabinet which provides support for a plurality of displays, inputs, controls, and other features of a conventional gaming machine. The gaming machine 10 can be positioned on a base or stand or can be configured as a pub-style table-top game (not shown) which a player can operate preferably while sitting. It should be appreciated that the gaming machine 10 may have varying cabinet and display configurations.

Figure 2:
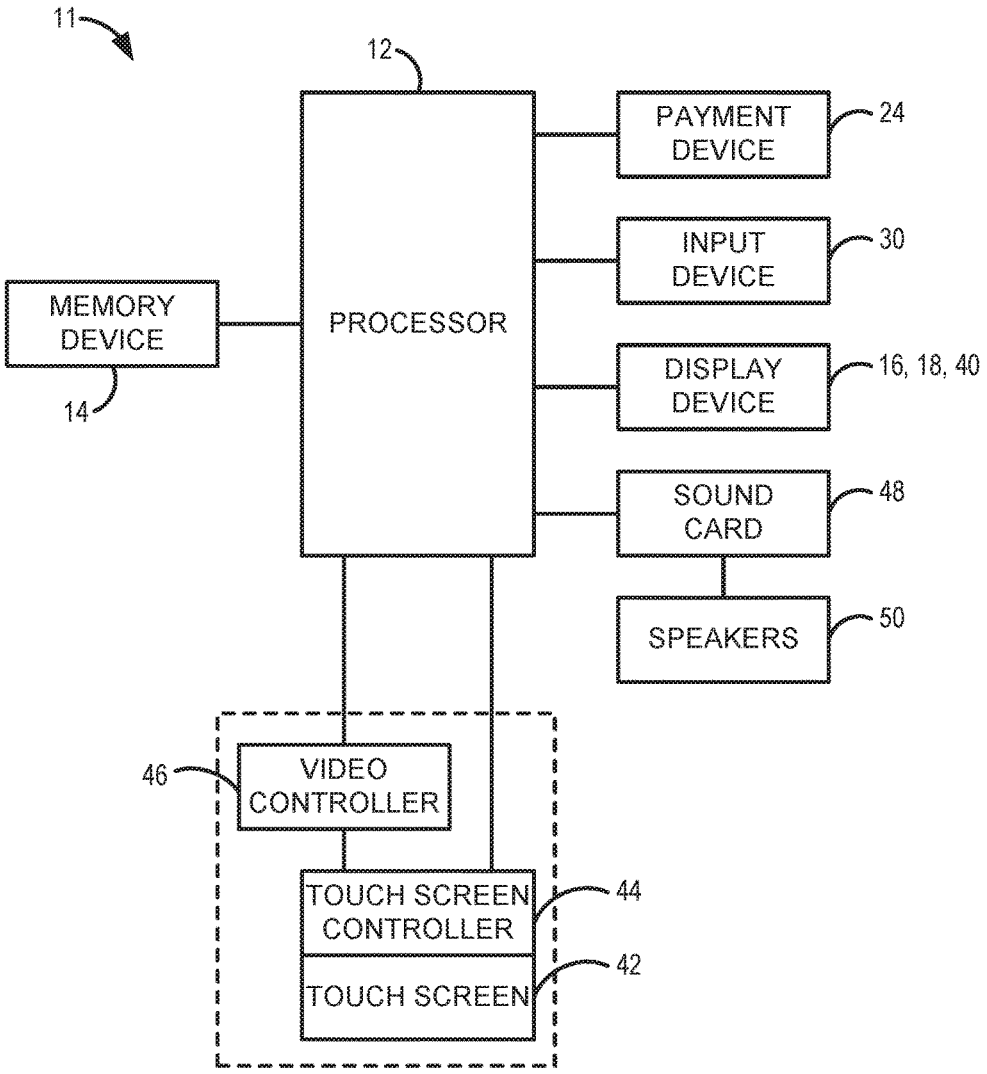
FIG. 2 is a diagrammatic view of an electronic system which allows for playing of a casino game with multiple reels, according to various embodiments.

In various embodiments, as illustrated in FIG. 2, an electronic system 11 for playing the casino game, according to the present disclosure, is shown. The electronic system 11 may be a separate gaming system or may be part of the gaming machine 10 of FIG. 1. The electronic system 11 includes at least one processor 12, such as a microprocessor, a microcontroller-based platform, a suitable integrated circuit or one or more application-specific integrated circuits (ASIC's). The processor 12 is in communication with or operable to access or to exchange signals with at least one data storage or memory device 14. In one embodiment, the processor 12 and the memory device 14 reside within the cabinet of the gaming machine 10. The memory device 14 stores program code and instructions, executable by the processor 12, to control the gaming machine 10. The memory device 14 also stores other data such as image data, event data, player input data, random or pseudo-random number generators, pay-table data or information, and applicable game rules that relate to the play of the casino game. In one embodiment, the memory device 14 includes random access memory (RAM), which can include non-volatile RAM (NVRAM), magnetic RAM (MRAM), ferroelectric RAM (FeRAM), and other forms as commonly understood in the gaming industry. In one embodiment, the memory device 14 includes read only memory (ROM). In one embodiment, the memory device 14 includes flash memory and/or electrically erasable programmable read only memory (EEPROM). It should be appreciated that, any other suitable magnetic, optical, and/or semiconductor memory may operate in conjunction with the electronic system 11.

In one embodiment, part or all of the program code and/or operating data described above can be stored in a detachable or removable memory device 14, including, but not limited to, a suitable cartridge, disk, CD ROM, DVD, or USB memory device. In other embodiments, part or all of the program code and/or operating data described above can be downloaded to the memory device 14 through a suitable network.

In various embodiments, an operator or a player can use a removable memory device in a desktop computer, a laptop computer, a hand-held device, such as a personal digital assistant (PDA), a portable computing or mobile device, or another computerized platform to implement present disclosure. In various embodiments, the electronic system 11 is operable over a wireless network, for example as part of a wireless gaming system. In such embodiments, the electronic system 11 may be a hand-held device, a mobile device, or any other suitable wireless device that enables a player to play any suitable game at a variety of different locations. In various embodiments in which the electronic system 11 is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor 12 and memory device 14 may be collectively referred to herein as a "computer" or "controller."

In one embodiment, the gaming machine 10 randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In one embodiment, as illustrated in FIG. 2, the electronic system 11 includes one or more display devices 16, 18, 40 controlled by the processor 12. Display devices 16, 18, 40 are preferably connected to or mounted on the cabinet of the gaming machine 10. The embodiment shown in FIG. 1 includes a central display device 16 which displays a primary or base game and an upper display device 18. This display device 16 may also display any suitable secondary game associated with the primary or base game as well as information relating to the primary or secondary game. The upper display device 18 may display the primary game, any suitable secondary game associated or not associated with the primary game and/or information relating to the primary or secondary game. These display devices may also serve as digital glass operable to advertise games or other aspects of the gaming establishment. As seen in FIG. 1, in one embodiment, the gaming machine 10 includes a credit display 20 which displays a player's current number of credits, cash, account balance, or the equivalent. In one embodiment, the gaming machine 10 includes a bet display 22 which displays a player's amount wagered. In one embodiment, the gaming machine 10 includes a player tracking display 40 which displays information regarding a player's play tracking status. It should be appreciated that these devices are in communication with the processor 12.

In another embodiment, at least one display device may be a mobile display device, such as a PDA or tablet PC, that enables play of at least a portion of the primary or secondary game at a location remote from the gaming machine 10 or electronic system 11.

Display devices 16, 18, 40 may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

Display devices 16, 18, 40 of the gaming machine 10 are configured to display at least one and preferably a plurality of games or other suitable images, symbols and indicia such as any visual representation or exhibition of the movement of objects such as mechanical, virtual, or video reels and wheels, etc., and the like.

In one embodiment, the symbols, images and indicia displayed on or of the display device may be in mechanical form. That is, the display device may include any electromechanical device, such as one or more mechanical objects, such as one or more rotatable wheels or reels configured to display at least one or a plurality of games or other suitable images, symbols or indicia.

As illustrated in FIG. 2, in one embodiment, the electronic system 11 includes at least one payment device 24 in communication with the processor 12. The payment device 24 may accept a physical item associated with a monetary value and may establish or increase a credit balance for the player based on the monetary value. The payment device 24 may be a payment acceptor including a note, ticket or bill acceptor 28 (shown in FIG. 1) wherein the player inserts paper money, a ticket, or voucher in a coin slot 26 (shown in FIG. 1) where the player inserts money, coins, or tokens. In other embodiments, payment devices 24 such as readers or validators for credit cards, debit cards or credit slips may accept payment.

In one embodiment, a player may insert an identification card into a card reader of the gaming machine 10. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming machine 10. In one embodiment, money may be transferred to a gaming machine 10 through electronic funds transfer. It should be appreciated that, when a player funds the gaming machine 10, the processor 12 determines the amount of funds entered and displays the corresponding amount on the credit or other suitable display as described previously.

As seen in FIGS. 1 and 2, in one embodiment, the gaming machine 10 and electronic system 11 include at least one and preferably a plurality of input devices 30 in communication with the processor 12. The input devices can include any suitable device which enables the player to produce an input signal which is received by the processor 12. In one embodiment, after appropriate funding of the gaming machine 10, the input device is a game activation device, such as a play button 32 or a pull arm (not shown) which is used by the player to start any primary or base game or sequence of events in the gaming machine 10. The play button can be any suitable play activator such as a bet one button, a max bet button, or a repeat the bet button. In one embodiment, upon appropriate funding, the gaming machine 10 begins the game play automatically. In another embodiment, upon the player engaging one of the play buttons, the gaming machine 10 automatically activates game play.

In one embodiment, one input device is a wager input device, such as a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button or one or more intermediate bet buttons (not shown) which enable the player to bet the maximum wager or one or more intermediate wagers, respectively, that are permitted or accepted for a game of the gaming machine 10.

In one embodiment, one input device is a cash out button 34. The player may push the cash out button and initiate a "cash out" operation to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. In one embodiment, the gaming machine 10 includes at least one card reader 38 in communication with the processor 12. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. It should be appreciated that any suitable payout mechanism, such as funding to the player's electronically recordable identification card or smart card, may be implemented in accordance with the gaming machine 10.

In one embodiment, as mentioned above and as seen in FIG. 2, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming machine 10 or the electronic system 11 by touching the touch-screen at the appropriate locations. One such input device is a conventional touch-screen button panel.

The electronic system 11 may further include a plurality of communication ports for enabling communication of the processor with external peripherals, such as external video sources, expansion buses, game or other displays, a SCSI port, or a keypad.

In one embodiment, as seen in FIG. 2, the electronic system 11 includes a sound generating device controlled by one or more sounds cards 48 which function in conjunction with the processor 12. In one embodiment, the sound generating device includes at least one and preferably a plurality of speakers 50 or other sound generating hardware and/or software for generating sounds, such as by playing music for the primary and/or secondary game or by playing music for other modes of the gaming machine 10, such as an attract mode. In one embodiment, the gaming machine 10 provides dynamic sounds coupled with attractive multimedia images displayed on one or more of the display devices to provide an audio-visual representation or to otherwise display full-motion video with sound to attract players to the gaming machine 10. During idle periods, the gaming machine 10 may display a sequence of audio and/or visual attraction messages to attract potential players to the gaming device. The videos may also be customized to provide any appropriate information.

The gaming machine 10 can incorporate any suitable wagering game as the primary or base game. The gaming machine 10 may include some or all of the features of conventional gaming machines or devices. In one embodiment, the primary or base game may be any suitable reel-type game susceptible to representation in an electronic or electromechanical form, which in one embodiment produces a random outcome based on probability data at the time of or after placement of a wager. Alternatively, the primary or base game may be a video poker game, a video bingo or keno game, a Class II game displayed using Class III visual elements (e.g., a video slot game that uses a bingo-based ball call), or any other suitable game.

In one embodiment, as illustrated in FIG. 1, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming machine 10 awards prizes after the reels of the primary or base game stop spinning if specified types and/or configurations of indicia or symbols occur on an active payline or otherwise occur in a winning pattern, occur on the requisite number of adjacent reels and/or occur in a scatter pay arrangement.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. It should be appreciated that, in one embodiment, the bonus or secondary game is similar to the base or primary game.

Figure 3:
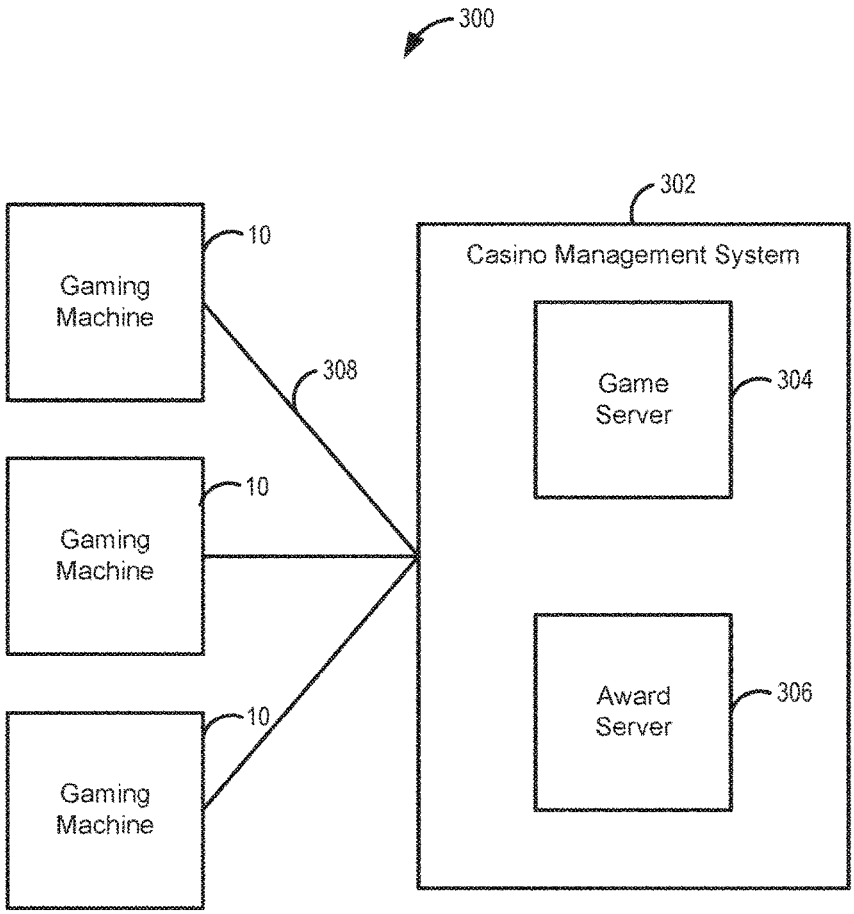
FIG. 3 is a block diagram of a gaming system which allows for playing of a casino game with multiple reels, according to various embodiments.

FIG. 3 is a block diagram illustrating a gaming system 300 for playing the casino game, according to various embodiments. The gaming system 300 includes a casino management system 302 that is coupled to one or more gaming machines 10. Casino management system 302 includes a game server 304 and an award server 306 in communication with each other and each server may be in communication with gaming machines 10.

In this embodiment, game server 304 and award server 306 include at least one processor and at least one memory or storage device. In an alternative embodiment, award server 306 or game server 304 may be implemented as a progressive controller or a processor of one of the gaming machines 10 in the gaming system.

In the embodiments described herein, the processor of each gaming machine 10 is designed to transmit and receive events, messages, commands, or any other suitable data or signal between the individual gaming machine 10 and casino management system 302 (e.g., game server 304 and/or award server 306). The gaming machine processor is operable to execute such communicated events, messages, or commands in conjunction with the operation of the gaming machine 10. Moreover, the processors of the game server 304 and award server 306 are designed to transmit and receive events, messages, commands, or any other suitable data or signal between the central server and each of the individual gaming machines 10.

In one embodiment, a plurality of the gaming machines 10 are coupled together through a data network 308. In one embodiment, the data network 308 is a local area network (LAN), in which one or more of the gaming machines 10 are substantially proximate to each other within a gaming establishment or a portion of a gaming establishment. In another embodiment, the data network is a wide area network (WAN) in which one or more of the gaming machines 10 are in communication with at least one off-site casino management system.

In another embodiment, the data network is the Internet. In this embodiment, the operation of the gaming machine 10 can be viewed with an internet browser operating on a user device or another suitable computer. In this embodiment, operation of the gaming machine 10 and accumulation of credits may be accomplished with only a connection to the casino management system 302 through a conventional phone or other data transmission line, cell phone tower, digital subscriber line (DSL), T-1 line, coaxial cable, fiber optic cable, or other suitable connection. In this embodiment, players may access an internet game page from any location where an internet connection and computer or other internet facilitator is available.

In an exemplary embodiment, the present disclosure may be employed in a server-based gaming system. In one such embodiment, as described above, one or more gaming machines 10 are in communication with game server 304 and/or award server 306. In one embodiment, a memory device of game server 304 stores different game programs and instructions, executable by a gaming machine processor, to control the gaming machine 10. Each executable game program represents a different game or type of game which may be played on one or more of the gaming machines 10 in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming machine) or vice versa.

In operation, the processor of the game server 304 is operable to communicate one or more of the stored game programs to at least one gaming machine processor. In alternative embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the game server 304, the gaming machine processor executes the communicated program to facilitate play of the communicated program by a player through the display device(s) and/or input device(s) of the gaming machine. That is, when a game program is communicated to a processor of a gaming machine, the gaming machine processor changes the game or type of game played at the gaming machine.

The award server 306 is operable to calculate or determine an award or prize to be awarded to a player who satisfies a winning condition at a gaming machine 10. For example, in one embodiment, a progressive jackpot may be awardable to a player who satisfies a winning condition associated with the progressive jackpot. In one embodiment, the progressive jackpot is a mystery jackpot that is awarded to a player who causes the jackpot to exceed a randomly determined mystery jackpot threshold. The progressive jackpot may be awarded as a bonus prize in addition to a primary prize associated with a game, or may be awarded as the primary prize for a game. The operation of the award server is described more fully below with respect to FIG. 4, for example.

Figure 4:
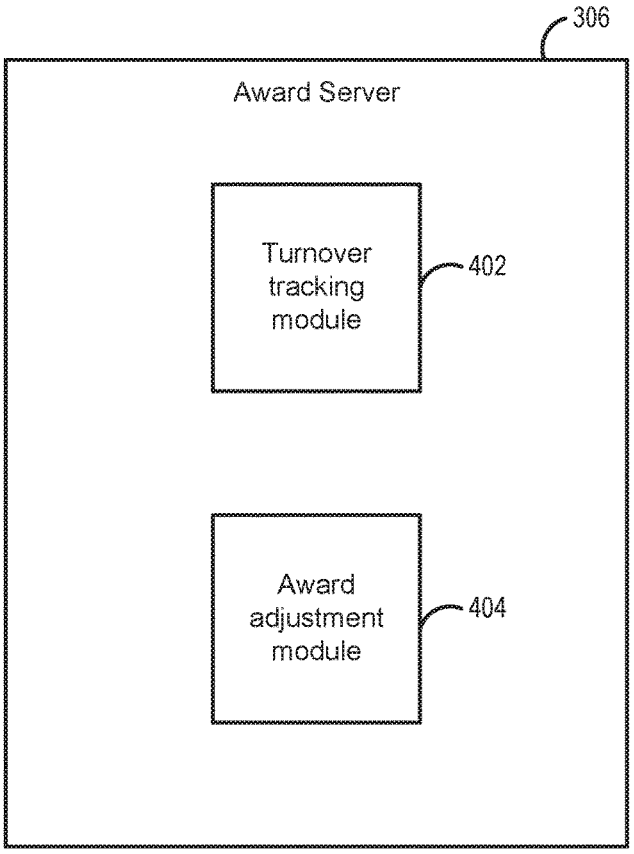
FIG. 4 is a block diagram of an exemplary award server that may be used with a gaming system, according to various embodiments.

FIG. 4 is a block diagram of an exemplary award server 306 that may be used with system 300 (shown in FIG. 3). In one embodiment, award server 306 includes a plurality of software modules that are stored in a computer-readable medium as a plurality of computer-executable instructions. Alternatively or additionally, the modules may be implemented in hardware (such as one or more circuits) and/or firmware. In one embodiment, the modules include a turnover tracking module 402 and an award adjustment module 404.

Turnover tracking module 402 tracks a turnover of each gaming machine 10 within system 300. As used herein, the term "turnover" refers to a rate of wagering activity on a particular gaming machine 10. As such, the turnover of a gaming machine 10 represents an amount of money wagered on that gaming machine during a predefined period of time.

In one embodiment, a processor of each gaming machine 10 determines the amount of wagering activity on that gaming machine and periodically transmits data representative of the wagering activity to turnover tracking module 402. The processors may determine and/or transmit the wagering activity to turnover tracking module 402 every 10 minutes, every minute, every 30 seconds, or at any other suitable period. Turnover tracking module 402 may aggregate and store the turnover data from each gaming machine 10 in a memory device of award server 306 or in a memory device coupled to award server 306.

In one embodiment, gaming machines 10 are grouped into one or more jackpot groups such that different jackpot groups play for different jackpots. For example, gaming machines 10 in a first jackpot group may play to win a first jackpot while gaming machines 10 in a second jackpot group may play to win a second jackpot.

Award adjustment module 404 determines and/or adjusts parameters relating to each mystery jackpot. Such parameters may include global or casino-wide parameters that may include, for example, an average or expected turnover per machine per day (or another suitable time period), a total number of gaming machines to participate in the mystery jackpot, and a total average or expected turnover of the gaming machines participating in the jackpot per day (or another suitable time period). The parameters may also include jackpot-specific parameters that may include, for example, a starting amount for the jackpot, a maximum amount for the jackpot, an average or expected value of the jackpot when hit (sometimes referred as the average hit value or amount), an average or expected hit turnover value, a startup percentage value for the jackpot, an increment percentage value for the jackpot, an average hit percentage value, an average number of hits per day (or other suitable time period), and a total expected payout for the jackpot per day (or other suitable time period). While the embodiment is described herein with reference to adjusting parameters for a mystery jackpot, it should be recognized that the embodiments described herein may be used with other suitable jackpots or prizes.

In one embodiment, while the above parameters may be determined by award server 306 (or another suitable server or device), only certain of the parameters may be adjusted by award server 306. For example, in one embodiment, award server 306 may adjust the increment percentage value, the startup amount for the jackpot, and the maximum amount for the jackpot, while the other parameters are not adjustable by award server 306.

The starting amount for the jackpot is the amount that the casino initially places into the jackpot after a player wins the jackpot. The maximum amount for the jackpot is the maximum value that the jackpot can reach before the jackpot is won. This represents the value of the jackpot at which a player has a 100% chance to win the jackpot assuming any other win conditions are met.

The average hit value represents the average jackpot amount when the mystery jackpot is hit. This is equal to the average of the startup amount for the jackpot and the maximum amount for the jackpot (i.e., the startup amount plus the maximum amount divided by 2) when the mystery jackpot amount is a random number selected between the startup amount and the maximum amount.

The average hit turnover value represents the average amount of turnover needed to cause the jackpot to rise from the startup value of the jackpot to the level at which the jackpot is hit (i.e., the average hit value). This is equal to the average hit value divided by the increment percentage value.

The startup percentage value for the jackpot represents a percentage amount of the average hit turnover that is initially placed into the jackpot. This is calculated to be the average hit percentage value minus the increment percentage value.

The increment percentage value for the jackpot represents the percentage of each $1 wager that is allocated to increasing the jackpot amount. For example, a value of 0.1% indicates that $10 of wagering activity is needed to increase the jackpot amount by $0.01.

The average hit percentage value is calculated by dividing the average hit value by the average hit turnover value. The average number of hits per day is calculated by dividing the total average turnover for all of the gaming machines by the average hit turnover value. The total expected payout for the jackpot per day is calculated by multiplying the average number of hits per day by the average jackpot amount.

In some embodiments, award server 306 may determine and adjust parameters for a plurality of jackpots for the gaming machines. For example, one or more gaming machines may be able to win one of a plurality of mystery jackpots having different parameters.

In one embodiment, the above parameters represent desired parameters that are set up to achieve a desired total payout for the gaming system during a day (or other suitable time period). This desired total payout is calculated as the expected turnover for the aggregated gaming machines multiplied by the expected number of jackpot hits per day multiplied by the average value of the jackpot. If one or more parameters changes during the day (e.g., if an actual turnover is higher or lower than the average or expected turnover for one or more gaming machines), award server 306 may adjust one or more parameters for one or more jackpots to maintain the desired total payout of the system. For example, each jackpot may have a different startup amount, a different maximum amount, and a different expected or average hit amount. A random number generator executed within, or by, award server 306 or another suitable server or device may randomly select the hit value for each jackpot to be awarded to a player.

The following example describes one embodiment in which the award server 306 may determine and adjust jackpot parameters to achieve and maintain a desired total payout for a jackpot, gaming machine, or the overall gaming system. The desired total payout for the jackpot, gaming machine, or the overall gaming system may be represented as a monetary value or may be represented as a percentage value of the overall turnover for the gaming machines participating in the jackpot (i.e., the startup percentage value plus the increment percentage value). The desired total payout for the overall gaming system is the sum of the desired total payout of each jackpot or gaming machine implemented by the system.

In this example, each gaming machine that participates in a mystery jackpot transmits one or more signals to award server 306 representing its turnover (i.e., total amount wagered per day or other suitable time period). Award server 306 receives the turnover data from each gaming machine and calculates an average turnover per gaming machine. If the turnover per machine rises above a threshold or rises a predetermined amount or percentage above the threshold (e.g., the previously determined average turnover), award server 306 may automatically reduce the increment percentage value for the jackpot by an amount proportional to the increased turnover to maintain the same expected total payout. If the turnover per machine decreases below the threshold or decreases a predetermined amount or percentage below the threshold (e.g., the previously determined average turnover), award server 306 may automatically increase the increment percentage value for the jackpot by an amount proportional to the decreased turnover to maintain the same expected total payout. Conversely, if the turnover per machine does not change with respect to the threshold, or does not change by the predetermined amount or percentage with respect to the threshold, then award server 306 may maintain the parameters without change.

In one embodiment, if award server 306 determines that the turnover (or another suitable parameter) increases above the threshold or decreases below the threshold, award server 306 may transmit a notification to a computer or other device operated by an operator to notify the operator of the changed parameter. In addition, award server 306 may transmit the proposed modification to the increment percentage value (or other modified parameter) to enable the operator to approve or reject the proposed modification. If the operator approves the modification, award server 306 implements the proposed modification and transmits the modified parameter to the gaming machines participating in the mystery jackpot. However, if the operator rejects the proposed modification to the increment percentage value (or other parameter), award server 306 may maintain the parameter without change.

In one embodiment, instead of adjusting the parameter when the parameter rises above or falls below the threshold value, the operator or award server 306 may determine a range of values above and below the threshold value within which no change to the parameter will occur. For example, the operator or award server 306 may determine that no change to the parameter will occur unless the parameter exceeds the threshold by a selected amount or percentage (e.g., 5% above the threshold) or the parameter decreases below the threshold by a selected amount or percentage (e.g., 5% below the threshold).

In one embodiment, award server 306 may determine and/or adjust one or more parameters only after award server 306 determines that the jackpot has been hit or awarded. In another embodiment, award server 306 may wait a predetermined or selected time period after the parameter has been determined to rise above or fall below the threshold before adjusting the parameter.

In another embodiment, if the turnover for each game machine or for the aggregated gaming machines rises above or falls below the threshold, award server 306 may adjust one or more parameters (e.g., the increment percentage value, the startup jackpot amount, and/or the maximum jackpot amount) for one or more jackpots but not for one or more other jackpots. In other words, the increased or decreased turnover may be apportioned to one or more jackpots but not to one or more other jackpots managed by award server 306.

While the embodiments described herein may be implemented using an award server 306 of a casino management system, it should be recognized that the embodiments may alternatively be implemented on each gaming machine by the controller or processor of that gaming machine.

Figure 5:
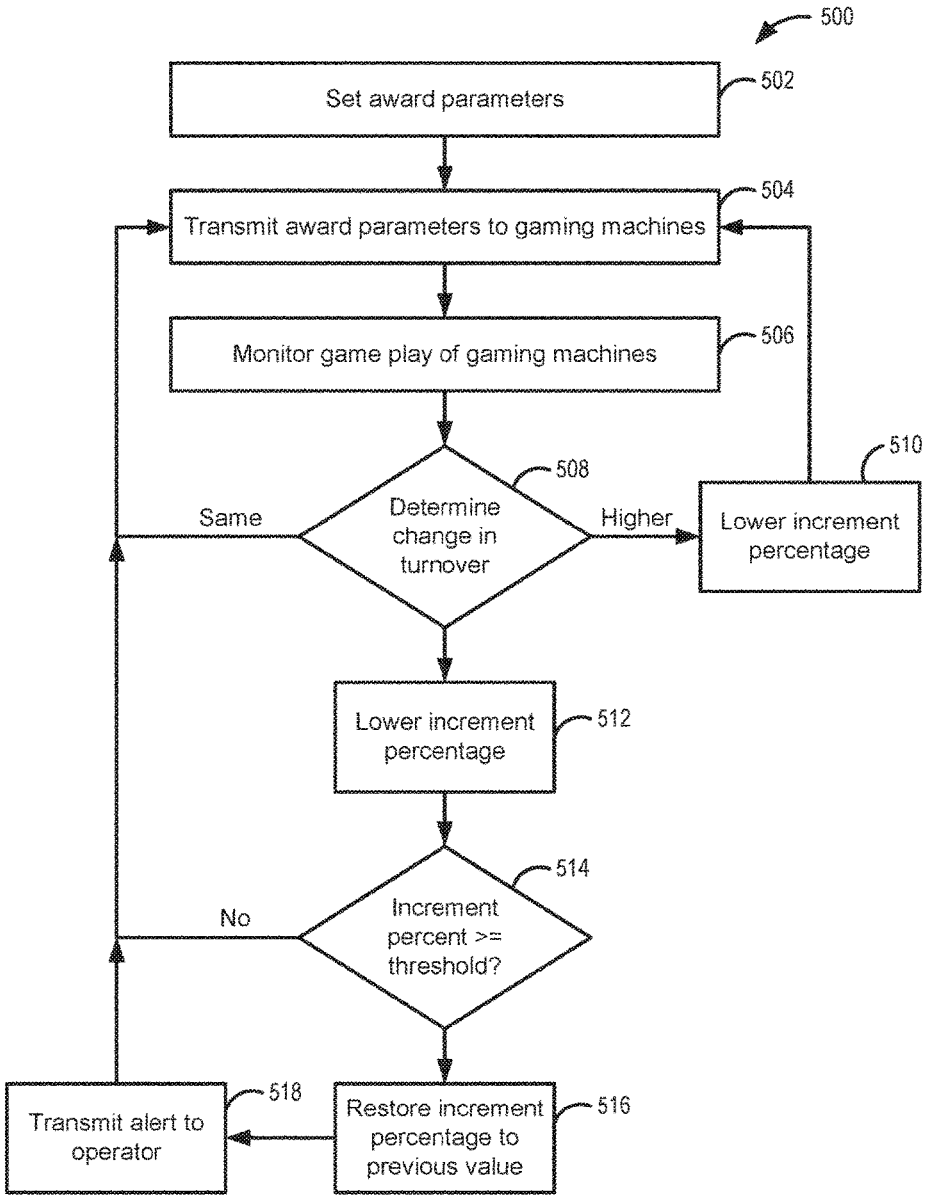
FIG. 5 is a flow diagram of an exemplary method of managing wagering game awards that may be used with a gaming system, according to various embodiments.

FIG. 5 is a flow diagram of an exemplary method 500 for managing wagering game awards that may be used with system 300 (shown in FIG. 3). In an exemplary embodiment, method 500 is implemented by award server 306. Accordingly, each step of method 500 may be implemented as one or more computer-executable instructions and/or modules that are executed by a processor of award server 306 to perform the functions described herein.

In one embodiment, one or more award parameters are set 502 or otherwise determined by award server. For example, the parameters for the mystery jackpot described above with respect to FIG. 4 may be determined and set by the award server.

The award parameters are transmitted 504 from the award server to the gaming machines participating in the mystery jackpot. The award server may monitor 506 a game play of the gaming machines, including monitoring the different parameters related to the mystery jackpot. For example, the award server may monitor the turnover for each gaming machine in response to turnover data transmitted from each gaming machine to the award server.

The award server determines 508 a change in turnover for each gaming machine. For example, the award server may compare the turnover data received from each gaming machine to an expected or average turnover for each gaming machine as determined above. In one embodiment, the award server sets a turnover threshold value to be the expected or average turnover for each gaming machine as described above.

In one embodiment, if the award server determines that the turnover for a gaming machine exceeds the turnover threshold value, the award server lowers 510 the increment percentage value as described above and transmits 504 the parameters, including the adjusted increment percentage value, to the gaming machines participating in the mystery jackpot. If the award server determines that the turnover for the gaming machine is the same as the turnover threshold value or has not changed from a previous turnover value, the award server may transmit 504 the unchanged parameters to the gaming machines or may return to monitoring 506 the game play of the gaming machines without transmitting the unchanged parameters to the machines.

If the award server determines that the turnover is lower than the threshold, the award server may increase 512 the increment percentage value as described above. The award server may then determine 514 whether the increment percentage value is greater than or is equal to a predetermined increment value threshold. If the increment percentage value is not greater than the increment value threshold, or is not equal to the threshold, the award server transmits 504 the parameters, including the adjusted increment percentage value, to the gaming machines participating in the mystery jackpot.

However, if the award server determines that the increment percentage value is greater than, or is equal to, the increment value threshold value, the award server may restore 516 the increment percentage value to its previous value (or may otherwise not change the increment percentage value from its prior value) and may transmit 518 an alert or notification to an operator of the award server or gaming system. The alert may enable the operator to adjust the increment percentage value to another value selected by the operator, for example.

While method 500 has been described herein as monitoring the turnover of the gaming machines and adjusting the increment percentage value in response to changes to the turnover, it should be recognized that method 500 may monitor any suitable parameter or parameters of the jackpots described herein and may adjust any suitable parameter or parameters in response to one or more parameter changes as desired.

Figure 6:
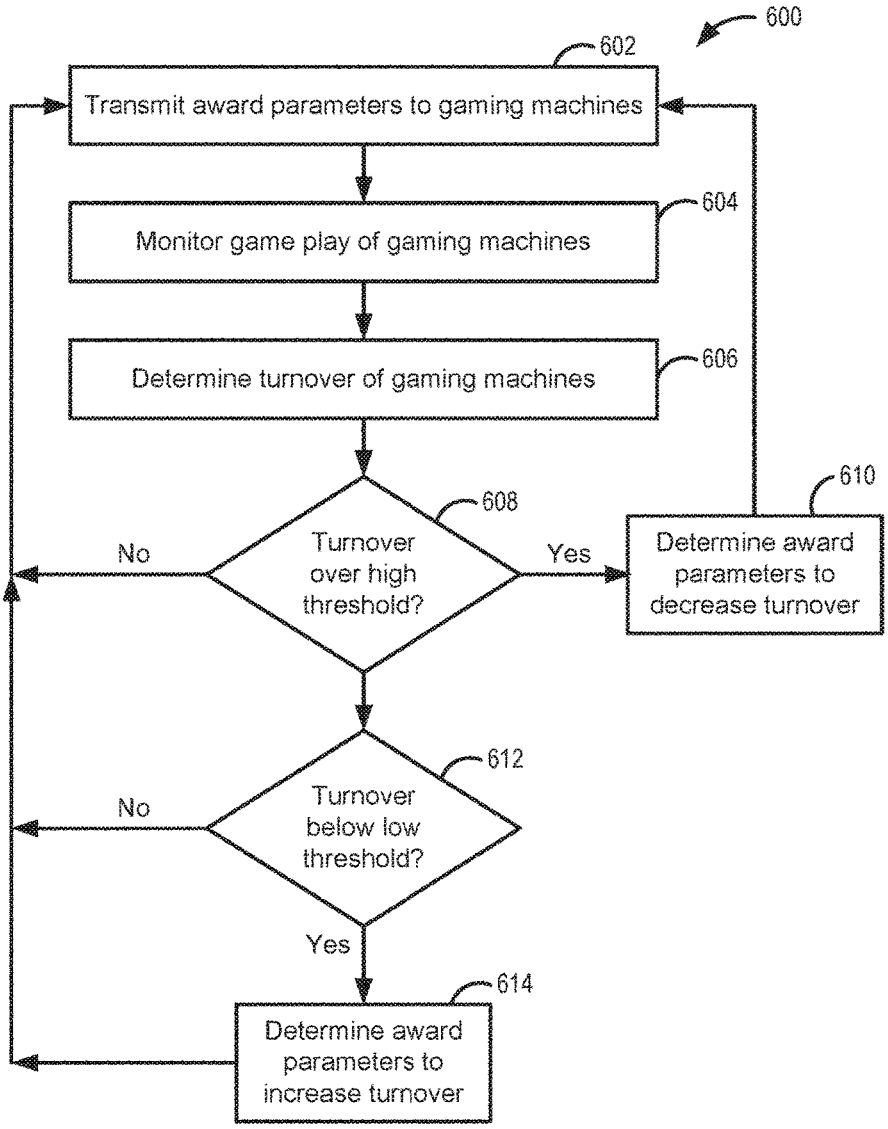
FIG. 6 illustrates a flow diagram of an exemplary method of managing wagering awards for use with a gaming system, according to various embodiments.

Referring now to FIG. 6, an exemplary method 600 is shown for operating a game management system 300, in accordance with various embodiments. Method 600 may be similar to method 500 in that it may operate on casino management system 302, game server 204, and/or award server 306 to control behavior of gaming machines 10. Gaming system 300 may transmit award parameters to gaming machines (Step 602). As described above, the parameters for the mystery jackpot may be determined and set by the award server. The award parameters may be transmitted from the award server 304 to the gaming machines 10 participating in a jackpot to control the behavior of gaming machines 10.

Gaming system 300 may monitor the game play of gaming machines 10 (Step 604). Monitoring game play may include receiving transmissions from gaming machines 10 indicative of wagering activity and/or payments occurring on each gaming machine 10. Each gaming machine 10 may thus transmit data indicative of activity on that particular machine. In various embodiments, the data may also be transmitted in the collective and representative of activity on multiple gaming machines 10.

Gaming system 300 may determine the turnover of gaming machines 10. The turnover may be determined as total turnover for a jackpot group by aggregating the turnover of each individual gaming machine associated with the jackpot group (Step 606). Gaming system 300 may also be configured to control turnover of individual gaming machines 10 by considering the turnover for the individual gaming machines. Although turnover is used as an exemplary parameter in method 600, gaming system 300 may be configured to monitor any parameter associated with a gaming machine 10 and/or wagering activity thereon, and automatically adjust the parameter in response to a predetermined criteria.

Gaming system 300 may determine whether the turnover is greater than (or equal to) a high threshold (Step 608). In response to the turnover being greater than the high threshold, gaming system 300 may determine projected parameters of the gaming machines 10 that will achieve a desired total turnover (Step 610). The projected parameters may be different parameters for each gaming machine 10 associated with a jackpot group. That is, each gaming machine 10 may have the same parameters or different parameters relative to other gaming machines 10. The projected parameters may include an increment value, a startup amount for the jackpot, a maximum amount for the jackpot, and/or other suitable parameters. Gaming system 300 may determine the projected parameters by working back from a desired turnover to projected parameters. The desired turnover may be compared to the detected turnover to determine a projected change in turnover.

Gaming system 300 may also determine whether the turnover is less than (or equal to) a low threshold (Step 612). The low threshold may be the same as or different than the previously discussed high threshold in various embodiments. Gaming system 300 may make a single comparison in various embodiments rather than multiple comparisons to various threshold values. In that regard, the low threshold and high threshold may define a range of values between which gaming system 300 seeks to maintain turnover.

In response to the turnover being less than the low threshold, gaming system 300 may determine projected parameters of the gaming machines 10 that will achieve a desired total turnover (Step 614). The projected parameters may be determined as described above, for example. Gaming system 300 may transmit the projected parameters to gaming machines 10 (Step 602) to update the awards parameters operative on the gaming machines and thereby control the behavior of the gaming machines. As described herein, the projected parameters may be transmitted to an operator for approval prior to transmitting the projected parameter to the gaming machines.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A method of operating a gaming system, comprising:

associating, by an award server, a plurality of gaming machines with a jackpot group having a jackpot, wherein the plurality of gaming machines comprises a gaming machine, wherein the gaming machine comprises a monetary input device configured to receive a physical item associated with a monetary value, and wherein the gaming machine comprises a wager input device configured to receive an input representative of a selected wager for a wagering game;

setting, by the award server, an award parameter for the gaming machine;

transmitting, by the award server, separate award parameters to each gaming machine in the plurality of gaming machines including transmitting the award parameter to the gaming machine;

determining, by the award server, a total turnover of the jackpot group based at least in part on a turnover of the gaming machine;

generating, by the award server, separate projected parameters for each gaming machine in the plurality of gaming machines to achieve a desired total turnover in response to the total turnover being greater than a threshold value, wherein the separate projected parameters include a projected parameter for the gaming machine; and transmitting, by the award server, the projected parameter for approval.

2. The method of claim 1, further comprising transmitting, by the award server, the projected parameter to the gaming machine to update the award parameter after the transmitting the projected parameter for approval.

3. The method of claim 1, wherein the award server determines the total turnover by aggregating a separate turnover of each gaming machine associated with the jackpot group.

4. The method of claim 1, wherein the award parameter generated by the award server includes at least one of an increment value, a startup amount for the jackpot, and a maximum amount for the jackpot.

5. The method of claim 1, further comprising updating, by the award server, the separate projected parameters for each gaming machine in response to the total turnover dropping below a second threshold value.

6. The method of claim 5, further comprising transmitting, by the award server, the updated separate projected parameters to the corresponding gaming machine from the plurality of gaming machines.

7. The method of claim 1, further comprising updating the separate projected parameters at a predetermined time.

8. A method of operating a gaming system, comprising:

receiving data from a gaming machine, wherein the data represents wagering activity on the gaming machine, wherein the gaming machine comprises a monetary input device configured to receive a physical item associated with a monetary value, wherein the gaming machine comprises a wager input device configured to receive an input representative of a selected wager for a wagering game;

generating a projected parameter for the gaming machine to achieve a desired wagering activity level in response to receiving the data from the gaming machine, wherein the projected parameter includes at least one of an increment value, a startup amount for a jackpot, or a maximum amount for the jackpot; and transmitting the projected parameter for approval.

9. The method of claim 8, further comprising transmitting the projected parameter to the gaming machine after the transmitting the projected parameter for approval.

10. The method of claim 8, further comprising associating a plurality of gaming machines with a jackpot group, wherein the plurality of gaming machines includes the gaming machine.

11. The method of claim 10, further comprising transmitting separate award parameters to each gaming machine in the plurality of gaming machines.

12. The method of claim 10, further comprising determining a total turnover based on a total wagering activity of the plurality of gaming machines associated with the jackpot group.

13. The method of claim 12, further comprising generating the separate award parameters to achieve the desired wagering activity level.

14. The method of claim 12, further comprising updating the separate award parameters in response to the total turnover exceeding a threshold value.

15. A method of operating a gaming system, comprising:

receiving, at a gaming server, data transmitted from a mobile device operating as a gaming machine, wherein the data represents wagering activity on the mobile device, wherein the mobile device is in communication with the gaming server over a network;

associating, by the gaming server, the mobile device with a jackpot group;

generating, by the gaming server, a projected parameter for the mobile device to achieve a desired wagering activity level in response to receiving the data from the mobile device, wherein the projected parameter includes at least one of an increment value, a startup amount for a jackpot, or a maximum amount for the jackpot;

restoring, by the gaming server, the projected parameter to a previous value in response to the projected parameter value being greater than a projected parameter threshold value; and transmitting, by the gaming server, the projected parameter to the mobile device.

16. The method of claim 15, further comprising transmitting the projected parameter for approval prior to transmitting the projected parameter to the mobile device.

17. The method of claim 15, further comprising associating a plurality of gaming machines with the jackpot group, wherein the plurality of gaming machines includes the gaming machine.

18. The method of claim 17, further comprising determining a total turnover based on a total wagering activity of the plurality of gaming machines associated with the jackpot group.

19. The method of claim 17, further comprising:

generating the separate award parameters to achieve the desired wagering activity level; and transmitting separate award parameters to each gaming machine in the plurality of gaming machines.

20. The method of claim 15, wherein the network comprises the Internet.

* * * * *